US008564525B2

(12) United States Patent
Cheng et al.

(10) Patent No.: US 8,564,525 B2
(45) Date of Patent: Oct. 22, 2013

(54) DRIVING DEVICE FOR LIQUID CRYSTAL DISPLAY

(75) Inventors: Tung-Shuan Cheng, Tainan County (TW); Yueh-Hsiu Liu, Hsinchu (TW); Kai-Shu Han, Hsinchu County (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 1152 days.

(21) Appl. No.: 12/430,110

(22) Filed: Apr. 27, 2009

(65) Prior Publication Data

US 2010/0045657 A1 Feb. 25, 2010

(30) Foreign Application Priority Data

Aug. 22, 2008 (TW) ..... 97132076 A

(51) Int. Cl.
*G09G 3/36* (2006.01)

(52) U.S. Cl.
USPC ..... 345/100; 345/98; 345/87

(58) Field of Classification Search
USPC ..... 345/204, 214, 87, 98–100; 377/64, 377/70–76
See application file for complete search history.

(56) References Cited

U.S. PATENT DOCUMENTS

| | | | | |
|---|---|---|---|---|
| 5,151,612 | A * | 9/1992 | Ishikawa | 327/34 |
| 6,121,803 | A | 9/2000 | Tanaka | |
| 2005/0024134 | A1 * | 2/2005 | Bolz et al. | 330/10 |
| 2006/0146979 | A1 * | 7/2006 | Jang et al. | 377/64 |

FOREIGN PATENT DOCUMENTS

| | | | |
|---|---|---|---|
| CN | 1797083 | A | 7/2006 |
| CN | 1991943 | A | 7/2007 |
| TW | I273274 | | 2/2007 |

* cited by examiner

*Primary Examiner* — Abbas Abdulselam
*Assistant Examiner* — Shawna Stepp Jones
(74) *Attorney, Agent, or Firm* — Winston Hsu; Scott Margo

(57) ABSTRACT

A driving device of a liquid crystal display (LCD) utilized for preventing noises of a clock signal from causing error operation of a shift register is disclosed. The driving device includes a shift register, a reception terminal, a noise elimination circuit and a control signal generation circuit. The reception terminal is utilized for receiving a first clock signal. The noise elimination circuit is coupled to the reception terminal, and is utilized for eliminating noises of the first clock signal and delaying the first clock signal for a preset time to generate a second clock signal. The control signal generation circuit is coupled to the reception terminal, the noise elimination circuit and the shift register, and is utilized for generating a first control signal and a second control signal to control the shift register.

20 Claims, 22 Drawing Sheets

DRIVING DEVICE FOR LIQUID CRYSTAL DISPLAY

BACKGROUND OF THE INVENTION

1. Field of the Invention

The present invention relates to a driving device for a liquid crystal display, and more particularly, to a driving device utilized for preventing noises of a clock signal from causing error operation of a liquid crystal display.

2. Description of the Prior Art

In a driving circuit of a liquid crystal display (LCD), a shift register is a widely employed digital logic circuit, and can sequentially provide a pulse signal to a plurality of data output terminals according to a clock signal, such that the driving circuit of the LCD can output source driving signals or gate driving signals line-by-line to drive corresponding pixels.

Please refer to FIG. 1. FIG. 1 is a functional block diagram of a gate driving circuit 10 of a conventional LCD. The gate driving circuit 10 mainly includes a shift register circuit 110 and an output buffer circuit 120. The shift register circuit 110 sequentially outputs pulse signals Q1~Qn according to an input pulse signal DIN and a clock signal CLK. The output buffer 120 then performs operations such as voltage amplification on the pulse signals Q1~Qn to generate gate driving signals X1~Xn for respective scan lines. In addition, the gate driving circuit 10 further includes an output control circuit 130. The output control circuit 130 is utilized for modulating the pulse signals Q1~Qn to avoid the adjacent gate driving signals X1~Xn overlapping with each other according to an Output Enable (OE) signal. Detailed operations of the driving circuit are well known by those skilled in the art, and thus not further described herein.

Generally, the shift register is formed by a plurality of series connected flip-flops, and can perform operations such as data registering, delay or conversion of serial and parallel output on input binary data. Please refer to FIG. 2. FIG. 2 is a schematic diagram of a conventional shift register circuit 20. The shift register circuit 20 can be the shift register 110 in FIG. 1, and includes cascaded flip-flops FF1~FFn. Each of the flip-flops FF1~FFn further includes an input terminal D, an output terminal Q and a clock input terminal C, and is utilized for shifting a logic level received by the input terminal D to the output terminal Q according to a clock signal CLK received by the clock input terminal C. In common cases, the output terminal of each flip-flop is coupled to the input terminal of a next stage flip-flop. Thus, when an input signal DIN is inputted to the input terminal of the first flip-flop FF1, the shift register circuit 20 then forward transfers a logic level of the input signal DIN stage-by-stage according to the clock signal CLK, so as to output pulse signals Q1~Qn in order. Related signal sequence of the shift register circuit 20 is shown in FIG. 3.

Please further refer to FIG. 4. FIG. 4 is a schematic diagram of a conventional flip-flop circuit 40. As shown in FIG. 4, the flip-flop circuit 40 generally includes two stages of latch circuit 41 and 42. When the clock signal CLK is logic low, the flip-flop circuit 40 stores the logic level of the input signal DIN into the first stage latch 41, and the second stage latch 42 is disabled. However, when the clock signal CLK is converted from logic low to logic high, the first stage latch 41 is then disabled while the second stage latch 42 is activated to output data stored by the first stage latch 41. In such a situation, when unexpected impulses exist in the clock signal CLK that caused by noise interference, the shift register circuit 20 is liable to operate in error.

For example, please refer to FIG. 5. FIG. 5 illustrates how noise interference causes error operation of a conventional shift register. As shown in FIG. 5, when the clock signal CLK has a downward unexpected impulse, each flip-flop of the shift register may perform data latch and output operation according to the error noise impulse, causing the shift register to output incorrect pulse signals. However, since the LCD panel needs to rely on a variety of signals for operation, coupling effects between signals, such as electromagnetic coupling for example, often induce noises to the clock signal of the driving circuit, causing the shift register to operate in error, so as to abnormally display images on the LCD panel.

Therefore, how to prevent the clock signal from noise interference is an important issue when designing the driving circuit of the LCD.

SUMMARY OF THE INVENTION

It is therefore an objective of the present invention to provide a driving device for a liquid crystal display.

According to the present invention, a driving device for a liquid crystal display is disclosed. The driving device includes a shift register, a reception terminal, a noise elimination circuit and a control signal generation circuit. The reception terminal is utilized for receiving a first clock signal. The noise elimination circuit is coupled to the reception terminal, and is utilized for eliminating noises of the first clock signal and delaying the first clock signal a preset time to generate a second clock signal. The control signal generation circuit is coupled to the reception terminal, the noise elimination circuit and the shift register, and is utilized for generating a first control signal and a second control signal to control the shift register according to the first clock signal and the second clock signal.

According to the present invention, a driving device for a liquid crystal display is further disclosed. The driving device includes a shift register, a reception terminal, a noise elimination circuit, a pulse width modulator and a control signal generation circuit. The reception terminal is utilized for receiving a first clock signal. The noise elimination circuit is coupled to the reception terminal, and is utilized for eliminating noises of the first clock signal and delaying the first clock signal a preset time to generate a second clock signal. The pulse width modulator is coupled to the noise elimination circuit, and is utilized for modulating pulse width of the second clock signal to generate a third clock signal. The control signal generation circuit is coupled to the reception terminal, the pulse width modulator and the shift register, and is utilized for generating a first control signal and a second control signal to control the shift register according to the first clock signal and the third clock signal.

According to the present invention, a driving device for a liquid crystal display is further disclosed. The driving device includes a shift register, a reception terminal, a noise elimination circuit and a control signal generation circuit. The reception terminal is utilized for receiving a first clock signal. The noise elimination circuit is coupled to the reception terminal, and is utilized for eliminating noises of the first clock signal and delaying the first clock signal a preset time to generate a second clock signal. The control signal generation circuit is coupled to the reception terminal, the noise elimination circuit and the shift register, and is utilized for generating a first control signal according to the first clock signal and an Output Enable (OE) signal and generating a second control signal according to the first clock signal and the second clock signal, wherein the OE signal is utilized for modulating output signals of the driving device to avoid overlap of the adjacent output signals and the first control signal and the second control signal is utilized for controlling the shift register.

These and other objectives of the present invention will no doubt become obvious to those of ordinary skill in the art after reading the following detailed description of the preferred embodiment that is illustrated in the various figures and drawings.

DETAILED DESCRIPTION

Figure 6:
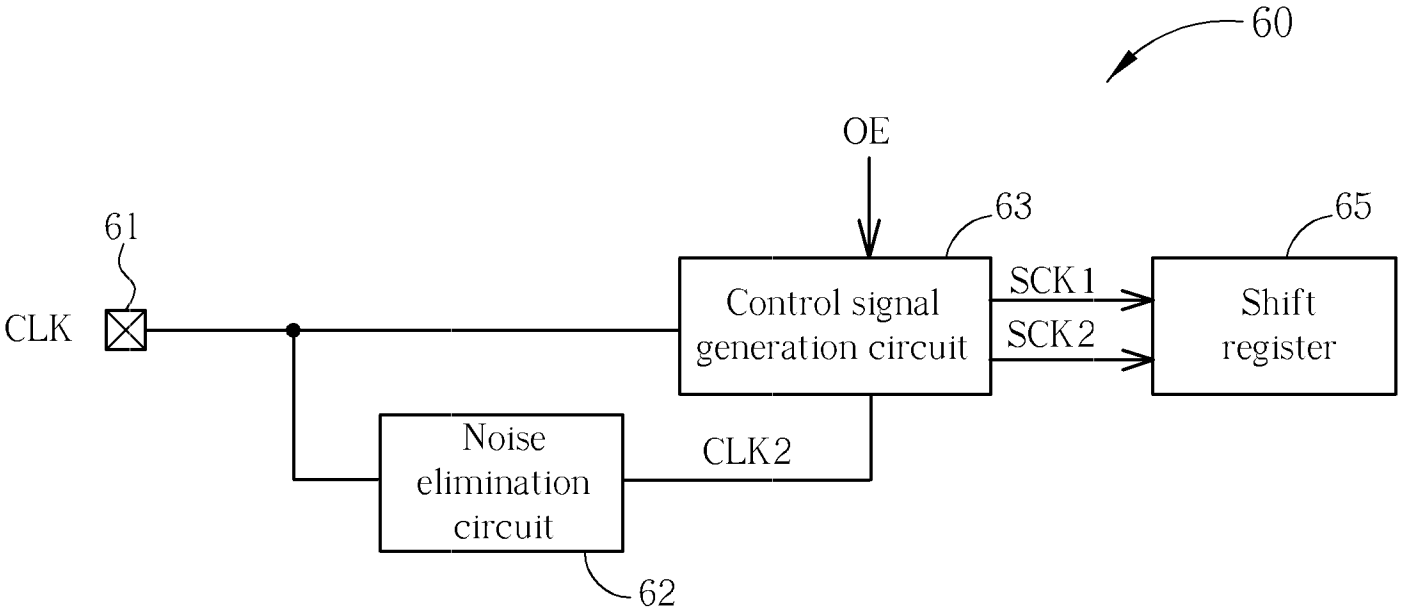
FIG. 6 is a schematic diagram of a driving device for an LCD according to an embodiment of the present invention.

Please refer to FIG. 6. FIG. 6 is a schematic diagram of a driving device 60 for a liquid crystal display (LCD) according to an embodiment of the present invention. The driving device 60 is utilized for preventing noises of a clock signal from causing error operation of a shift register, and includes a reception terminal 61, a noise elimination circuit 62, a control signal generation circuit 63 and a shift register 65. The reception terminal 61 is utilized for receiving a clock signal CLK. The noise elimination circuit 62 is coupled to the reception terminal 61, and is utilized for eliminating noises of the clock signal CLK and delaying the clock signal CLK for a preset time to generate a clock signal CLK2. The control signal generation circuit 63 is coupled to the reception terminal 61 and the noise elimination circuit 62, and is utilized for generating control signals SCK1 and SCK2 according to the clock signal CLK and CLK2, for controlling the shift register 65, so as to generate driving signals of the LCD.

Figure 7:
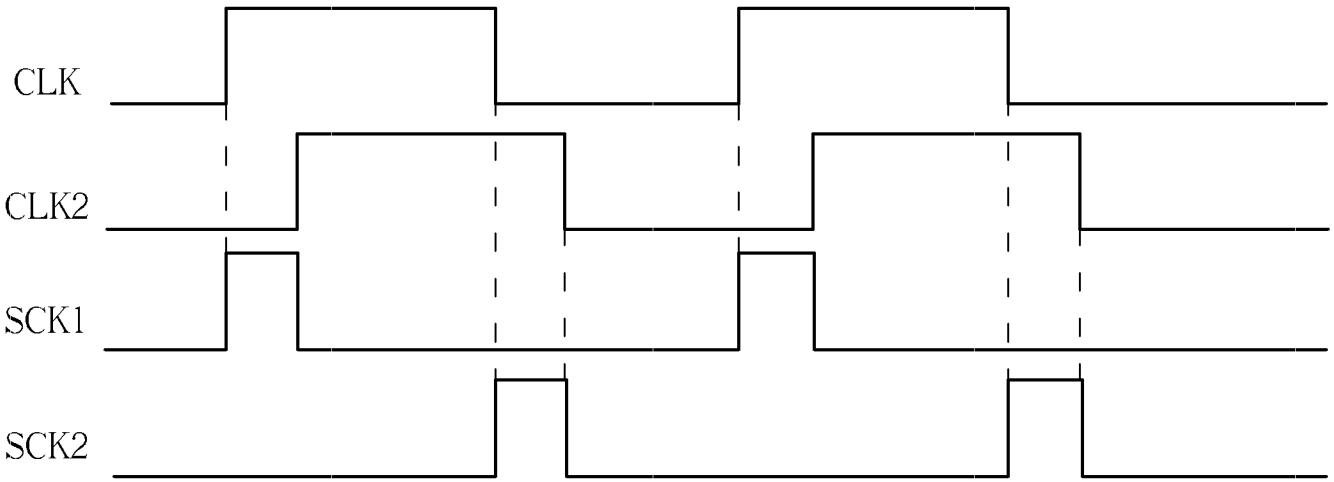
FIG. 7 illustrates related timing sequence of the driving device of FIG. 6.

Therefore, the present invention utilizes the original clock signal CLK and the noise eliminated clock signal CLK2 to generate the control signals of the shift register, so as to prevent the noises of the clock signal from causing error operation of the LCD. Preferably, the control signal SCK1 is generated when the clock signal CLK is logic high and the clock signal CLK2 is logic low, while the control signal SCK2 is generated when the clock signal CLK is logic low and the clock signal CLK2 is logic high. Related timing sequence of the above-mentioned signals is shown in FIG. 7.

Figure 8:
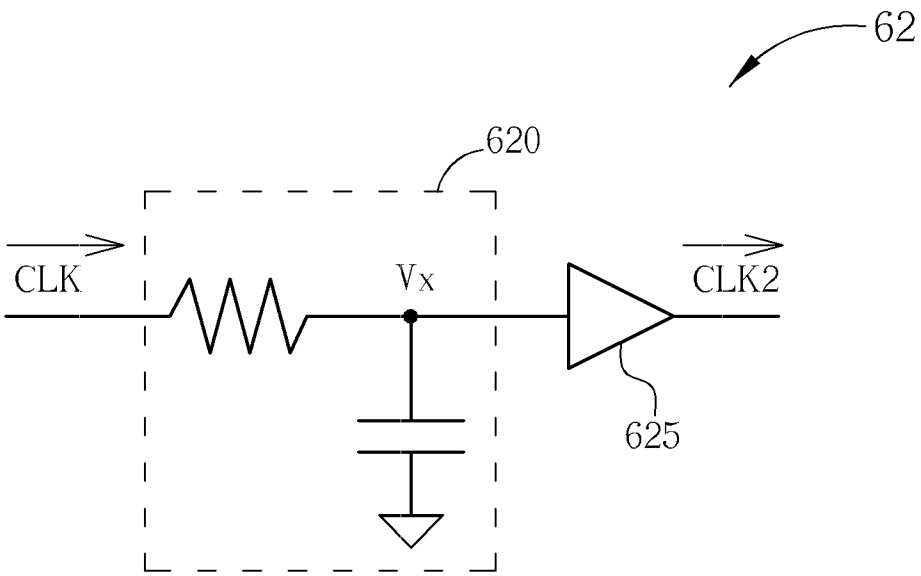
FIG. 8 is a schematic diagram of the noise elimination circuit of FIG. 6 according to an embodiment of the present invention.
Figure 9:
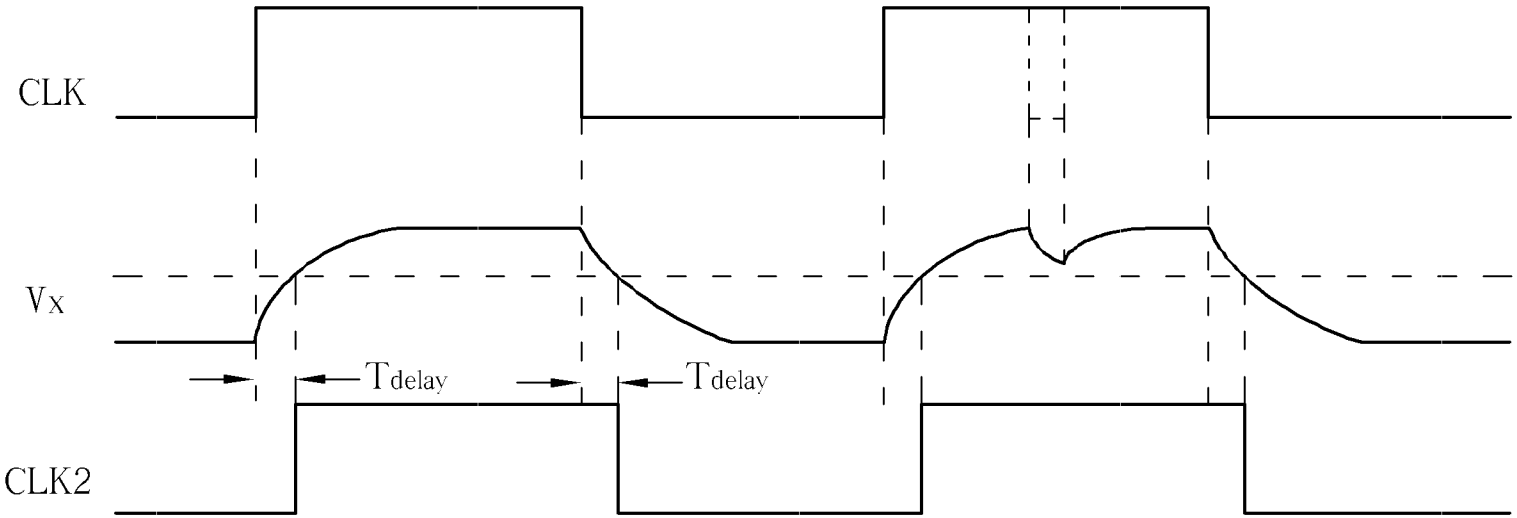
FIG. 9 illustrates detailed operation of the noise elimination circuit of FIG. 8.

Please further refer to FIG. 8. FIG. 8 is a schematic diagram of the noise elimination circuit of FIG. 6 according to an embodiment of the present invention. The noise elimination circuit 62 includes an RC (Resistor-Capacitor) filtering circuit 620 and a comparator 625. The RC filtering circuit 620 is coupled to the reception terminal 61, and is utilized for performing a filtering operation on the clock signal CLK to eliminate the noises of the clock signal CLK. The comparator 625 is coupled to the RC filtering circuit 620, and is utilized for comparing a filtering result Vx of the clock signal CLK with a threshold voltage VTH to generate the clock signal CLK2. The clock signal CLK2 is outputted as logic high when the filtering result Vx of the clock signal CLK is greater than the threshold voltage VTH, and is outputted as logic low when the filtering result Vx of the clock signal CLK is smaller than the threshold voltage VTH. As for detailed operation of the noise elimination circuit 62, please refer to FIG. 9, in which a preset time Tdelay that the clock signal CLK2 is delayed for is determined by a value of the threshold voltage VTH and a RC time constant of the RC filtering circuit 620.

Figure 1:
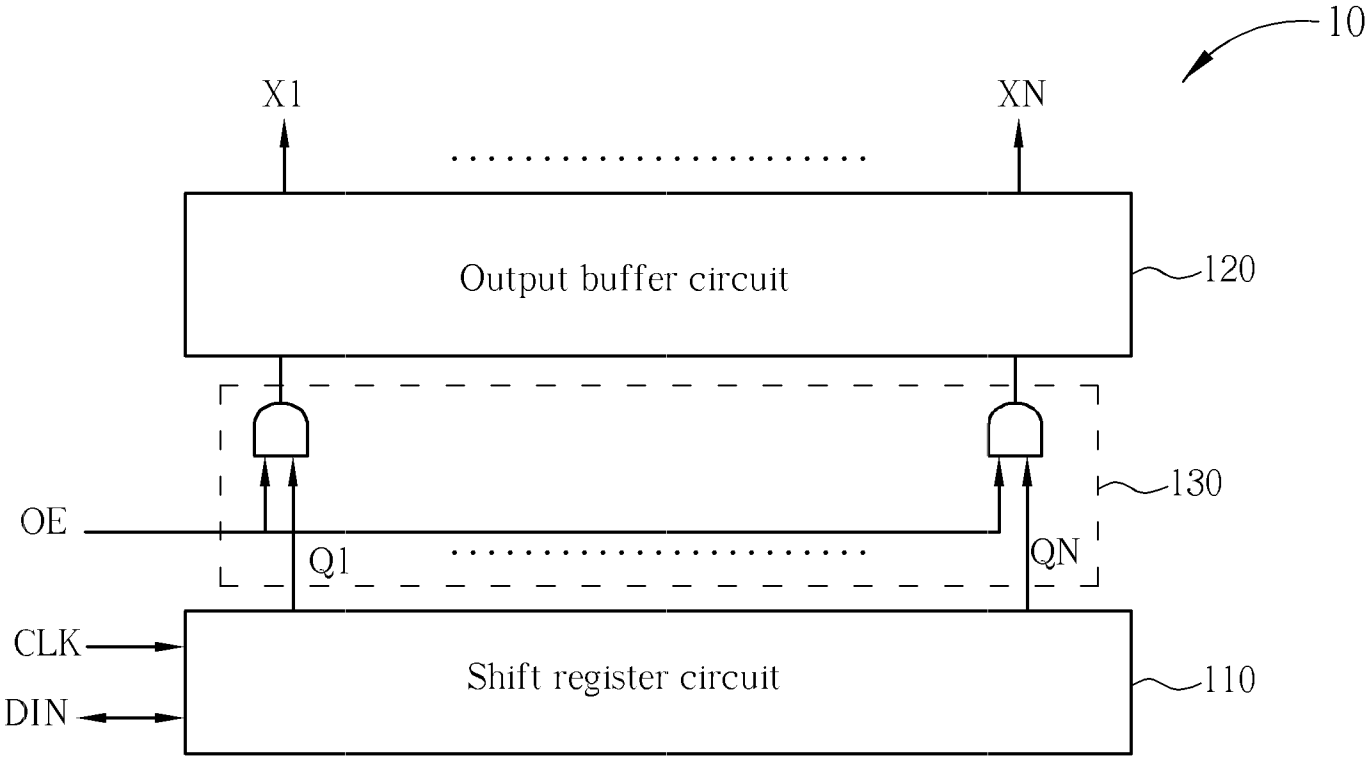
FIG. 1 PRIOR ART
FIG. 1 is a functional block diagram of a gate driving circuit of a conventional LCD.
Figure 2:
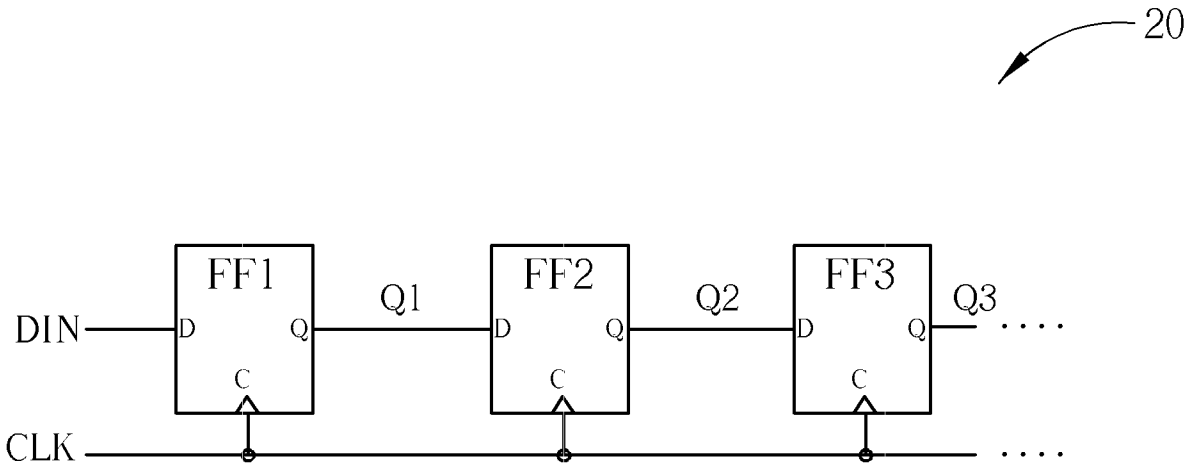
FIG. 2 PRIOR ART
FIG. 2 is a schematic diagram of a conventional shift register circuit.
Figure 3:
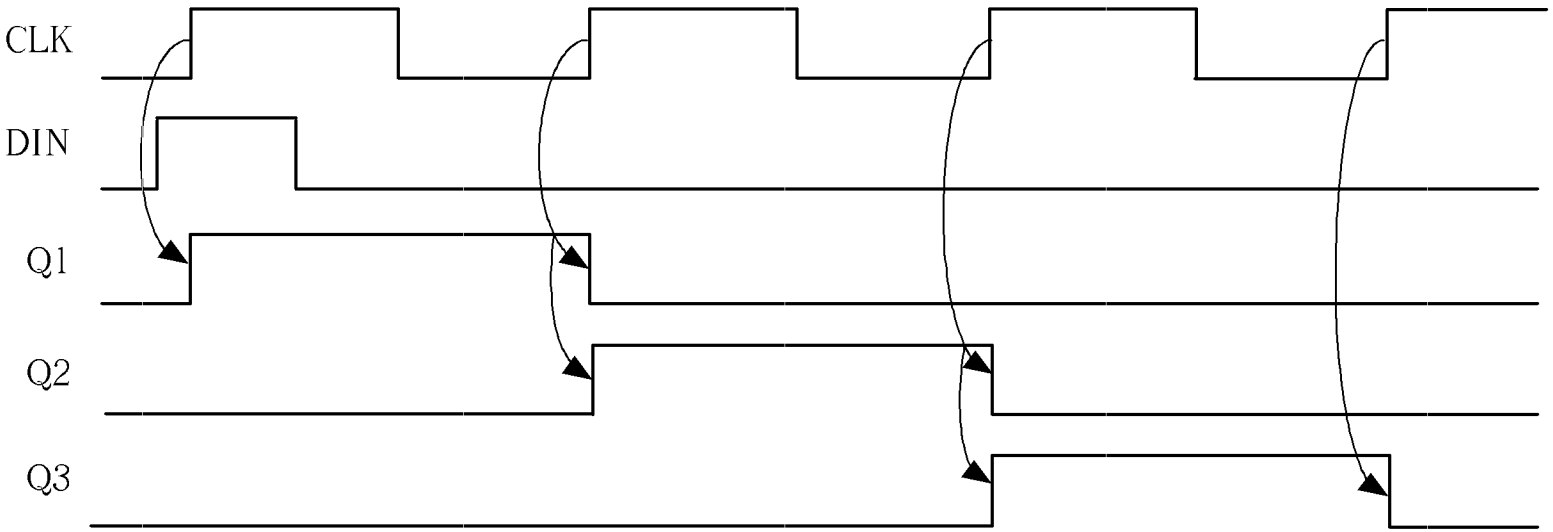
FIG. 3 PRIOR ART
FIG. 3 illustrates related signal sequence of the shift register circuit in FIG. 2.
Figure 4:
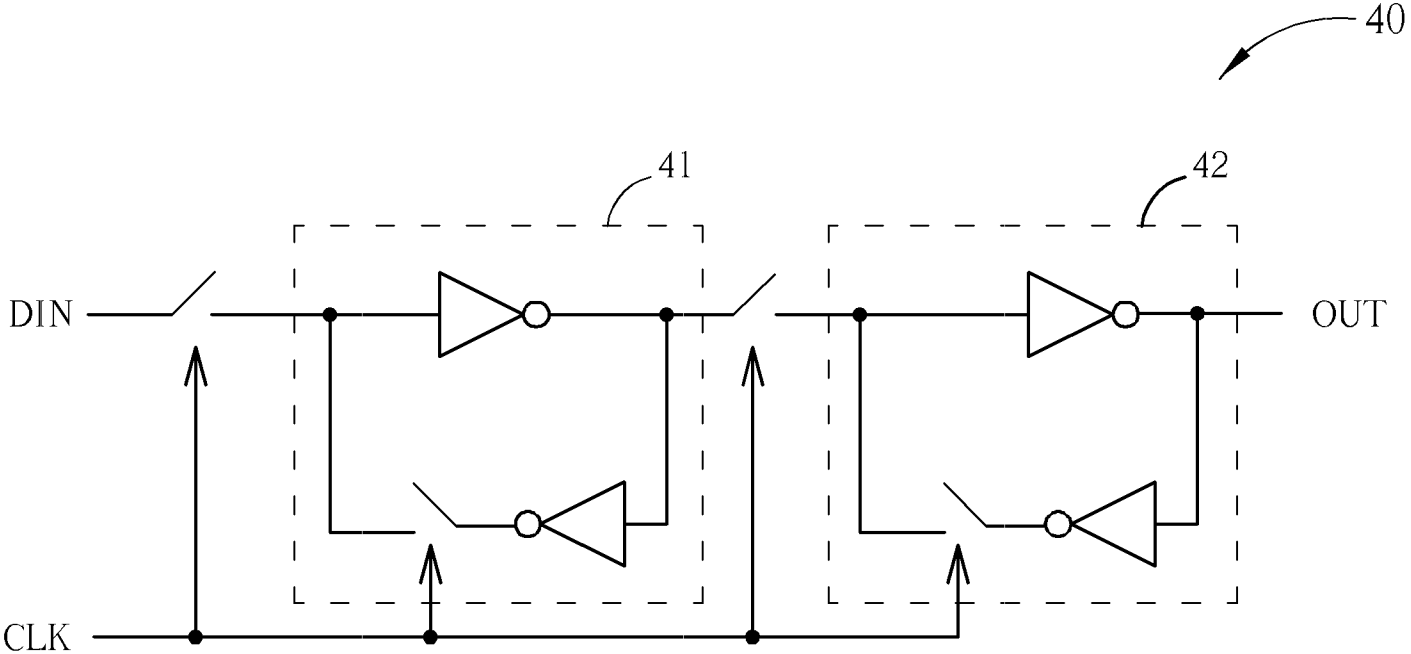
FIG. 4 PRIOR ART
FIG. 4 is a schematic diagram of a conventional flip-flop circuit.
Figure 5:
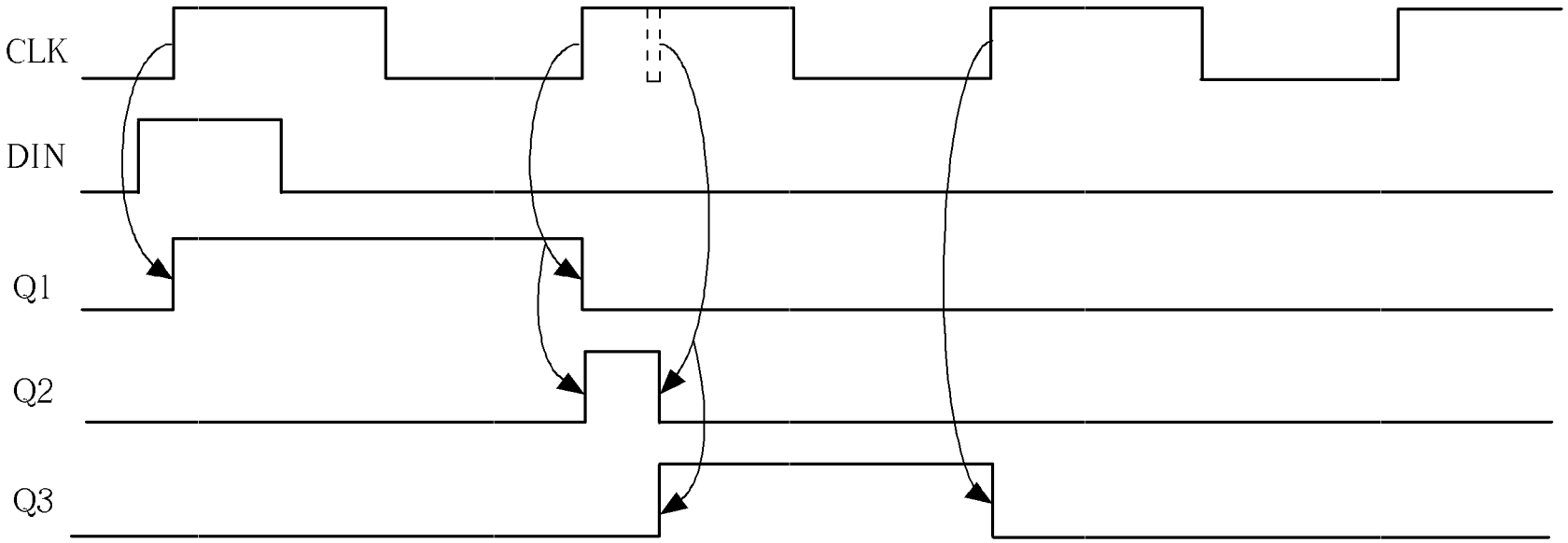
FIG. 5 PRIOR ART
FIG. 5 illustrates how noise interference causes error operation of a conventional shift register.
Figure 10:
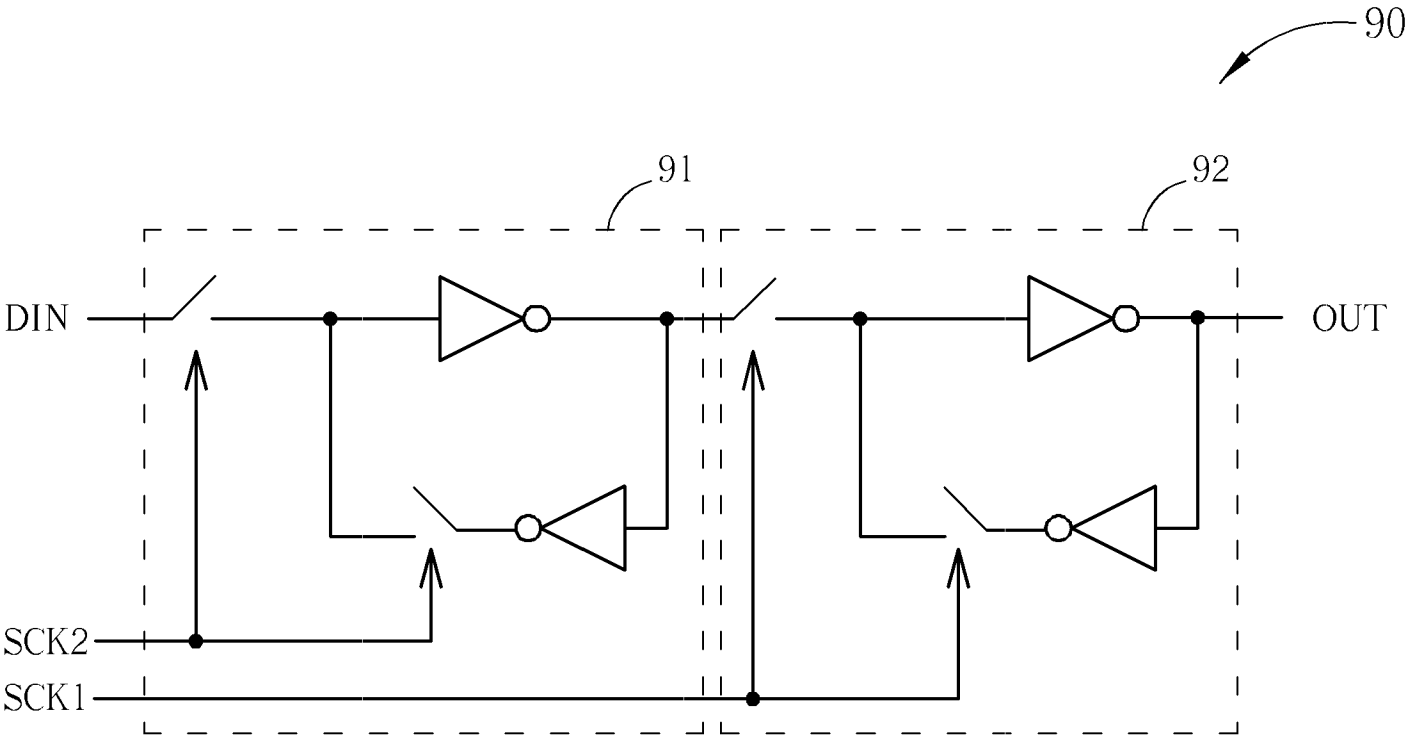
FIG. 10 is a schematic diagram of a flip-flop circuit for the driving device of FIG. 6 according to an embodiment of the present invention.

In addition, since each flip-flop of the shift register 65 is formed by two stages of latch circuit, the control signals SCK1 and SCK2 are respectively utilized for controlling the two stage latch circuits in the present invention, so as to correctly generate the driving signals of the LCD. For example, please refer to FIG. 10. FIG. 10 is a schematic diagram of a flip-flop circuit 90 for the driving device of FIG. 6 according to an embodiment of the present invention. The flip-flop circuit 90 is utilized for implementing each flip-flop circuit inside the shift register 65, and includes a first stage latch 91 and a second stage latch 92. Compared with the flip-flop circuit 40 of FIG. 4, the first stage latch 91 stores a logic level of an input data according to the control signal SCK2, while the second stage latch 92 outputs the stored voltage level of the first stage latch 91 according to the control signal SCK1.

Figure 11:
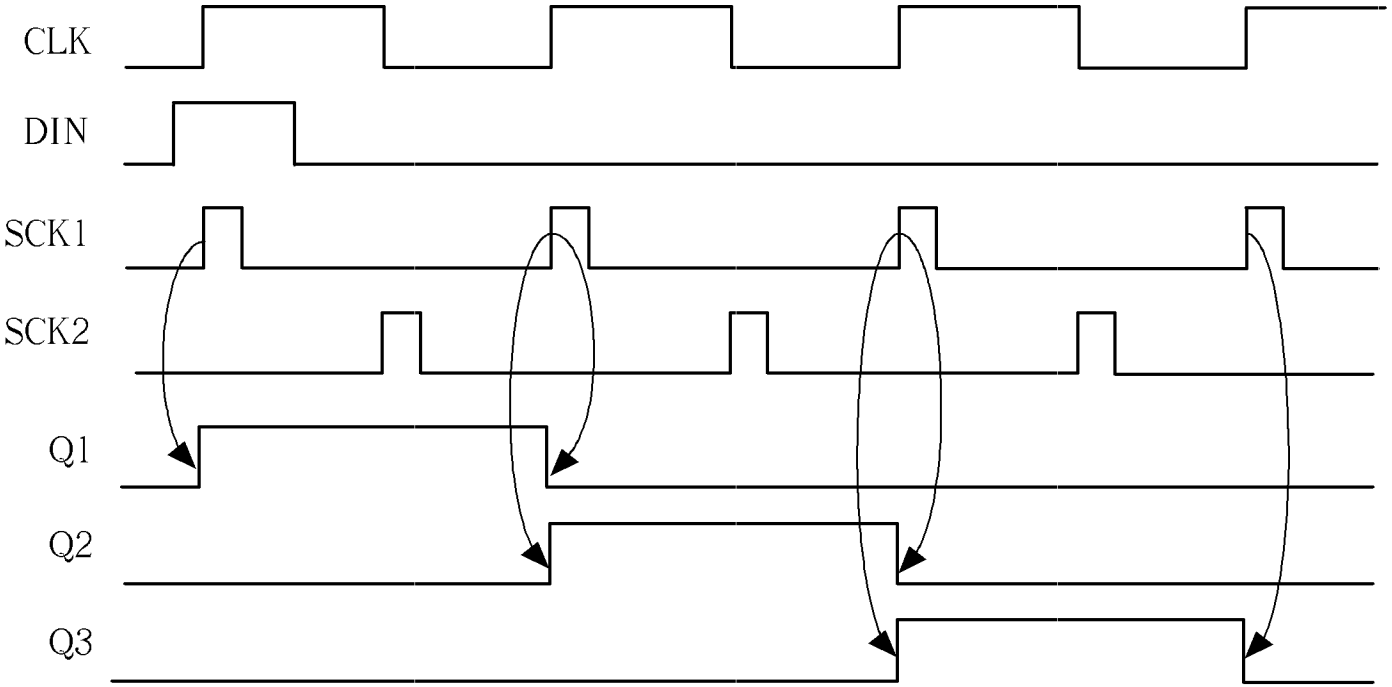
FIG. 11 illustrates related timing sequence of a shift register corresponding to the driving device of FIG. 6.

That is to say, when the control signal SCK2 is received by the shift register, each flip-flop circuit stores the logic level of the input signal into the first stage latch, and when the control signal SCK1 is received, each flip-flop circuit utilizes the second stage latch to output the stored logic level of the first stage latch. As for related timing sequence of the shift register, please refer to FIG. 11, in which DIN represents the input signal of the shift register, and Q1~Q3 represent pulse signals sequentially outputted by the shift register.

Figure 12:
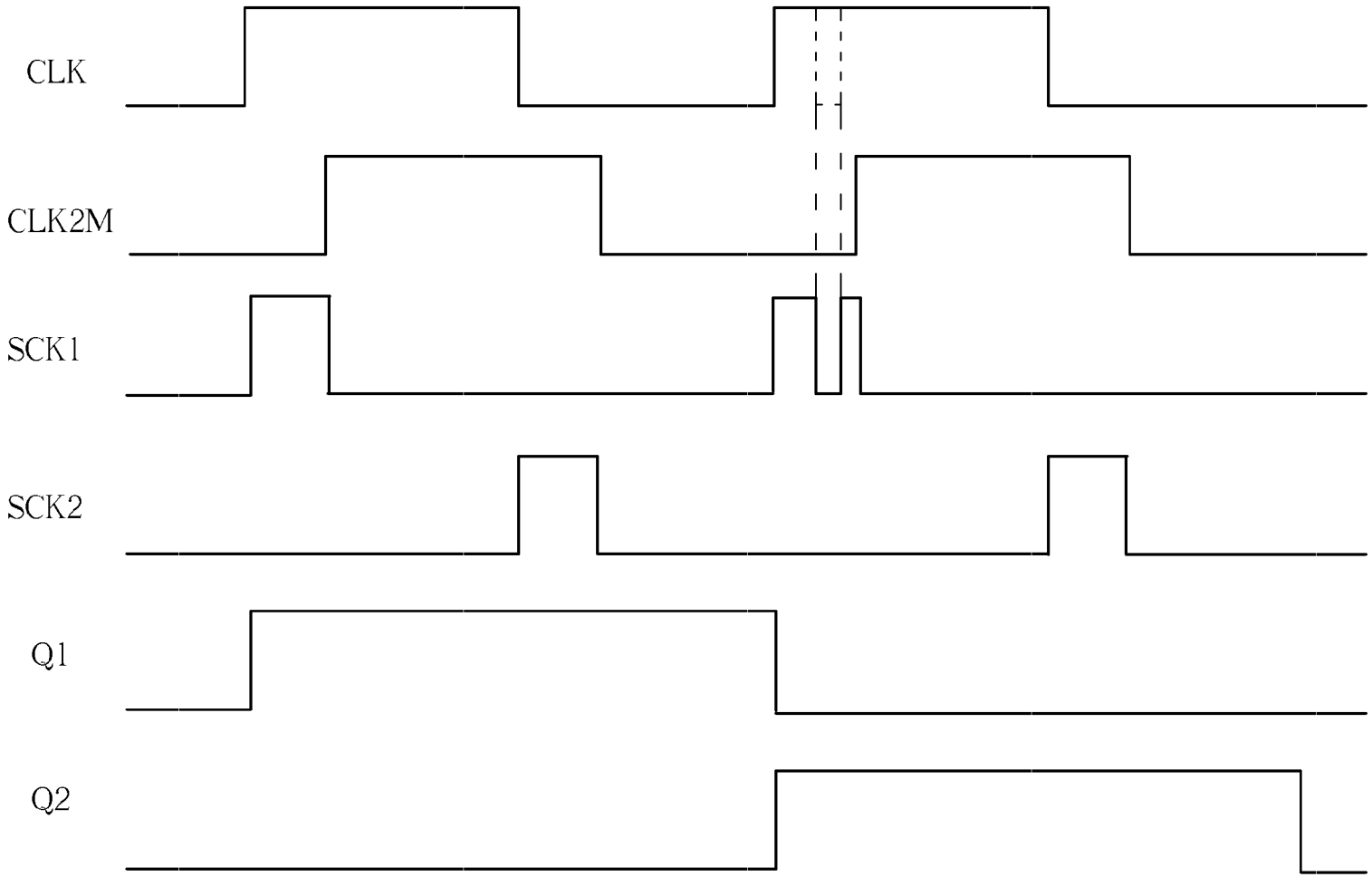
FIG. 12~14 are timing sequence diagrams of the driving device of FIG. 6 operated in different noise situations.
Figure 13:
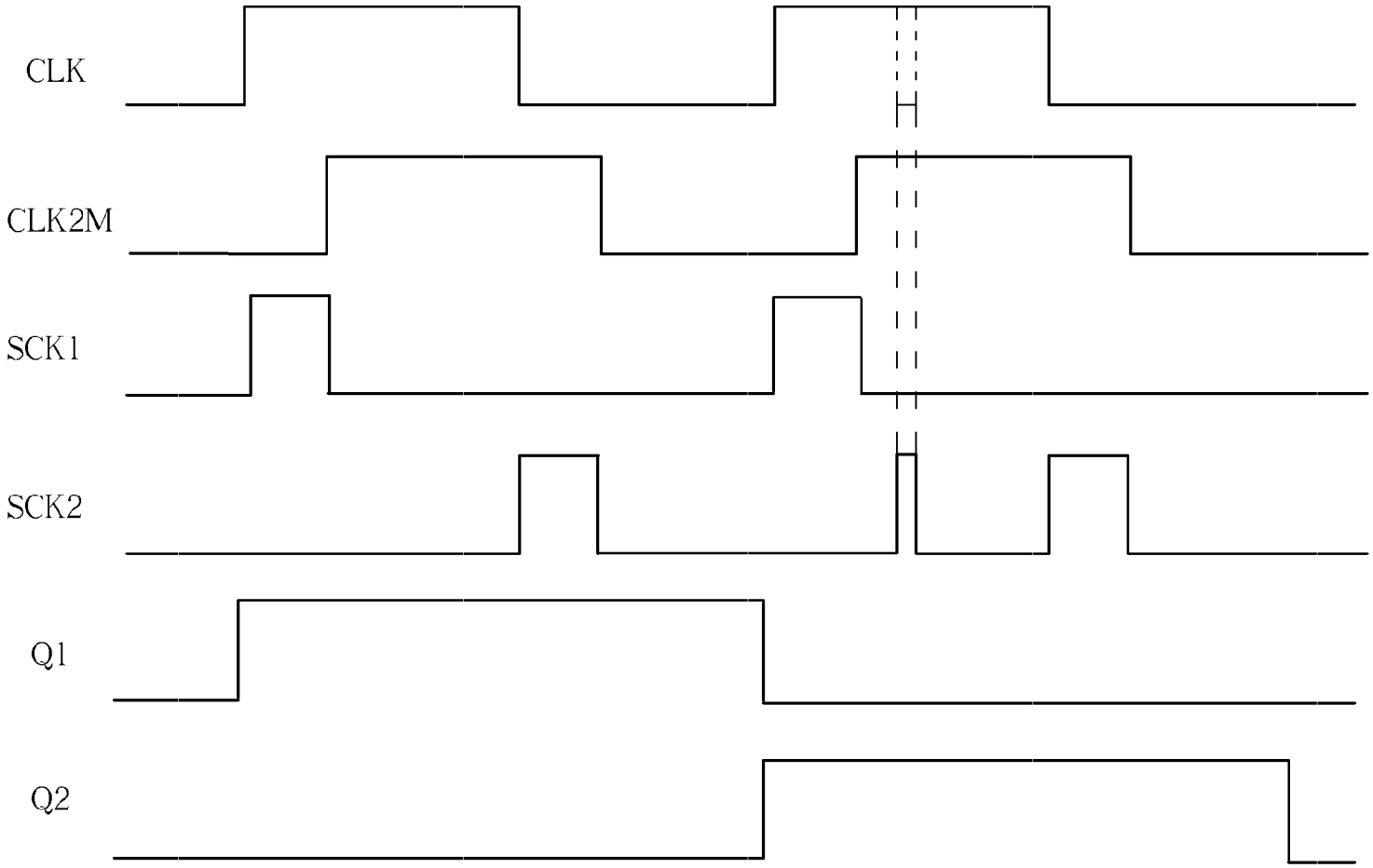
Figure 14:
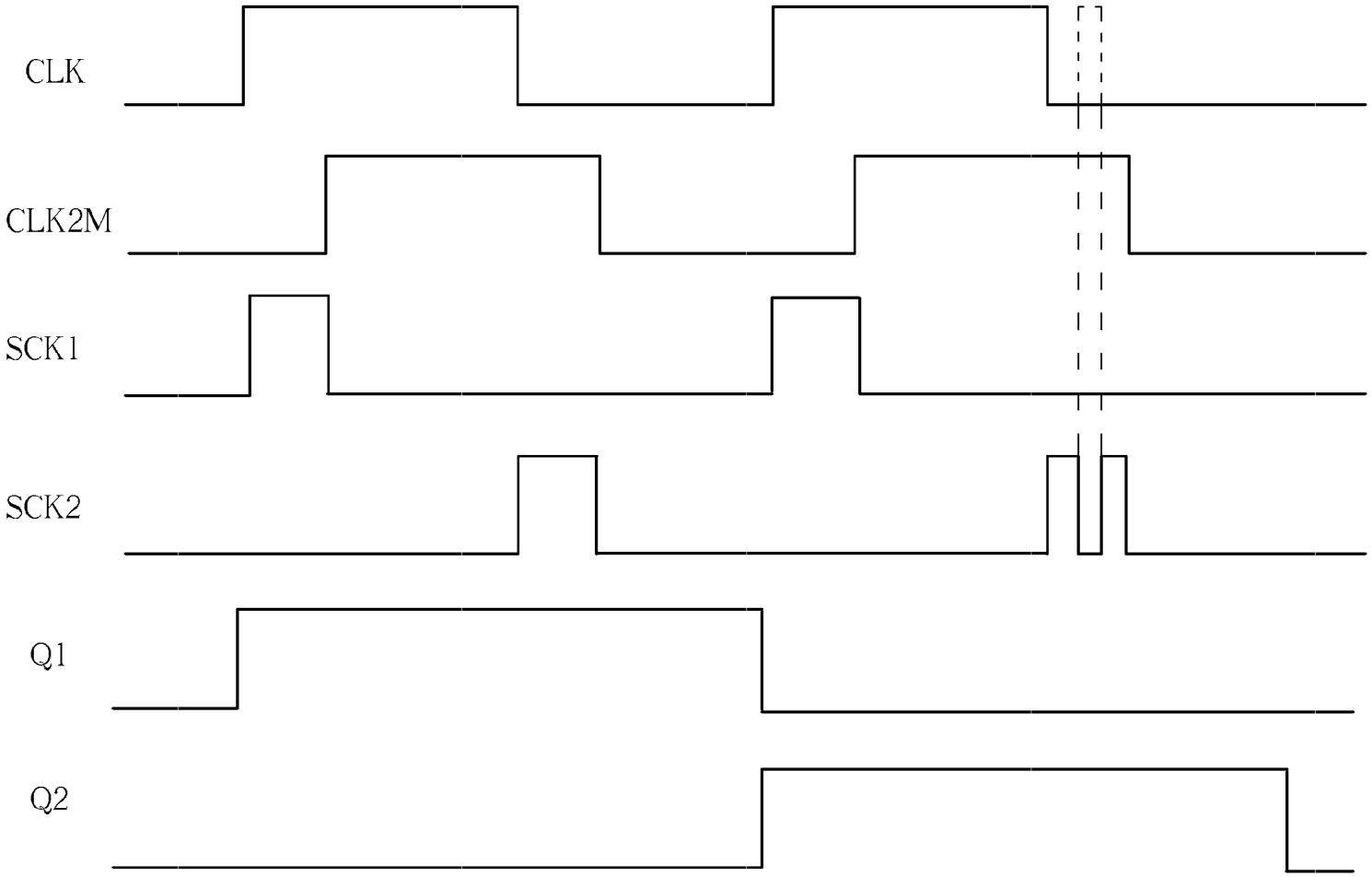

Therefore, by the control signal SCK1 and SCK2, the driving device 60 of the present invention can control the shift register to correctly generate the pulse signals that is required to drive the LCD, so as to avoid the noises of the clock signal causing error operation of the LCD. Please refer to FIG. 12~14. FIG. 12~14 are timing sequence diagrams of the driving device 60 of the present invention operated in different noise situations. As shown in FIG. 12, if the clock signal CLK exists a downward noise impulse in duration where the clock signal CLK is logic high but the clock signal CLK2 is logic low, the control signal SCK1 outputted by the control signal generation circuit 63 would be split into two smaller pulses. In such a situation, since there is no new data being latched by each flip-flop even though data output operation is twice performed, the output pulse signals of the shift register can be kept normal without being affected by the noise impulse of the clock signal. As shown in FIG. 13, if the clock signal CLK has a downward noise impulse in duration where both of the clock signals CLK and CLK2 are logic high, there would exist an additional pulse on the control signal SCK2. In such a situation, each flip-plop simply advances the data latch operation for next data, and thus the output pulse signals of the shift register can still be kept normal without being affected by the noise impulse of the clock signal. Further, as shown in FIG. 14, if the clock signal CLK has a noise impulse in duration where the clock signal CLK is logic low but the clock signal CLK2 is logic high, the control signal SCK2 would be split into two smaller pulses. In this case, each flip-flop merely performs twice data latch operation for the same data, so the output pulse signals of the shift register can be still kept normal without being affected by the noise impulse of the clock signal.

Figure 15:
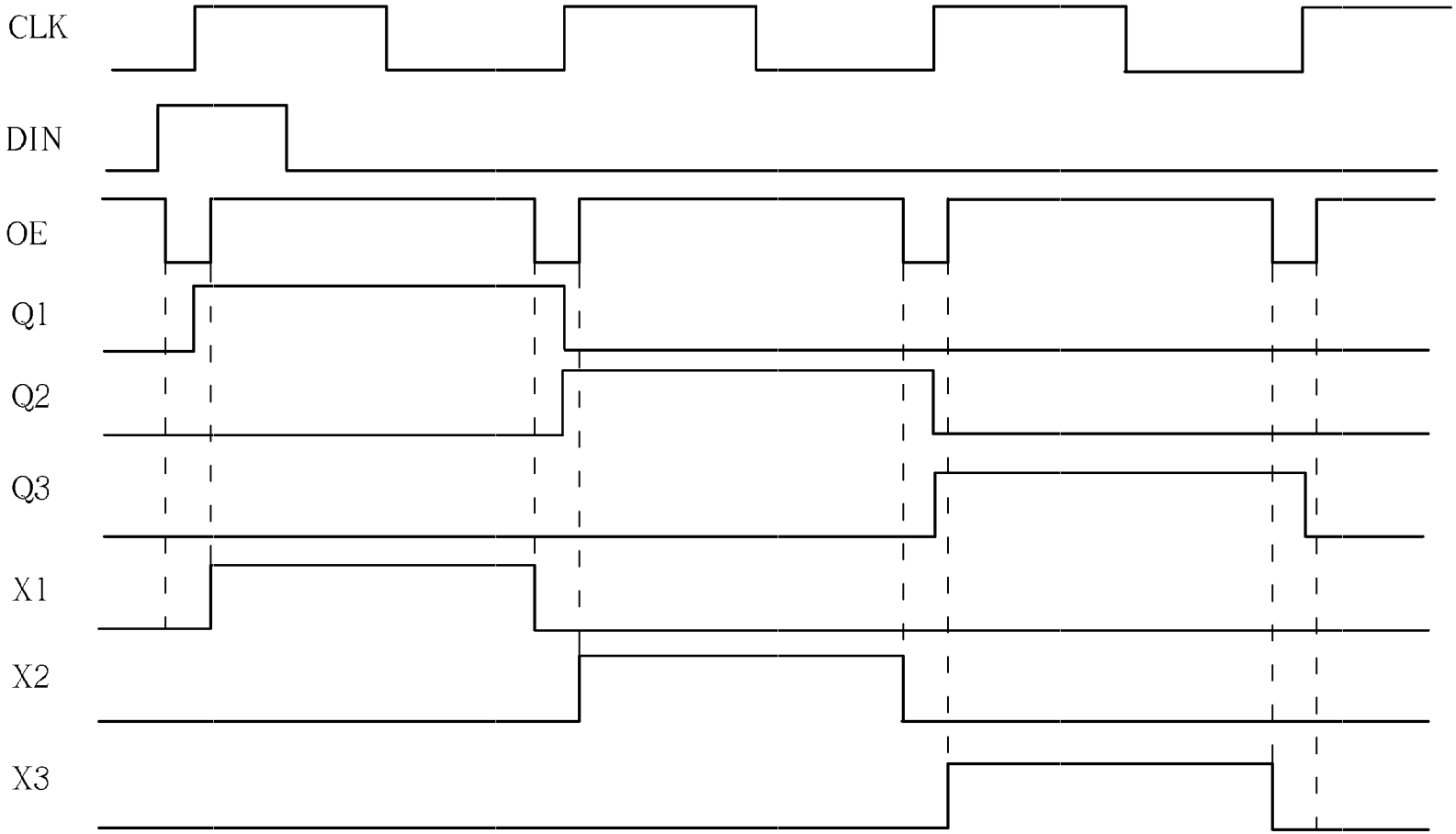
FIG. 15 illustrates how an output enable signal modulates output signals of a gate driver.

Preferably, the driving device of the present invention can be a gate driver of the LCD. Therefore, the control signal generation circuit 63 can generate the control signal SCK1 further based on an output enable (OE) signal, so as to prevent noises of the clock signal CLK from affecting the control signal SCK1. Firstly, please refer to FIG. 15. FIG. 15 illustrates how an output enable signal modulates output signals of a gate driver, in which DIN represents the input signal of the shift register, Q1~Q3 represent the pulse signals sequentially outputted by the shift register, and X1~X3 represent the driving signals outputted by the gate driver. As shown in FIG. 15, the output enable signal OE is utilized for modulating the pulse signals Q1~Q3 to avoid the adjacent gate driving signal X1~Xn overlapping with each other, which may cause error driving of the LCD.

Since the clock signal CLK is generally positive transitioned when the output enable signal OE is logic low for controlling the shift register to generate a next pulse, and thus the control signal generation circuit 63 can further utilize the output enable signal OE to eliminate the improper noises of the control signal SCK1. In this case, the control signal generation circuit 63 can regularly generate the control signal SCK1 when the output enable signal OE is logic low, but stop outputting the control signal SCK1 when the output enable signal OE is logic high.

Figure 16:
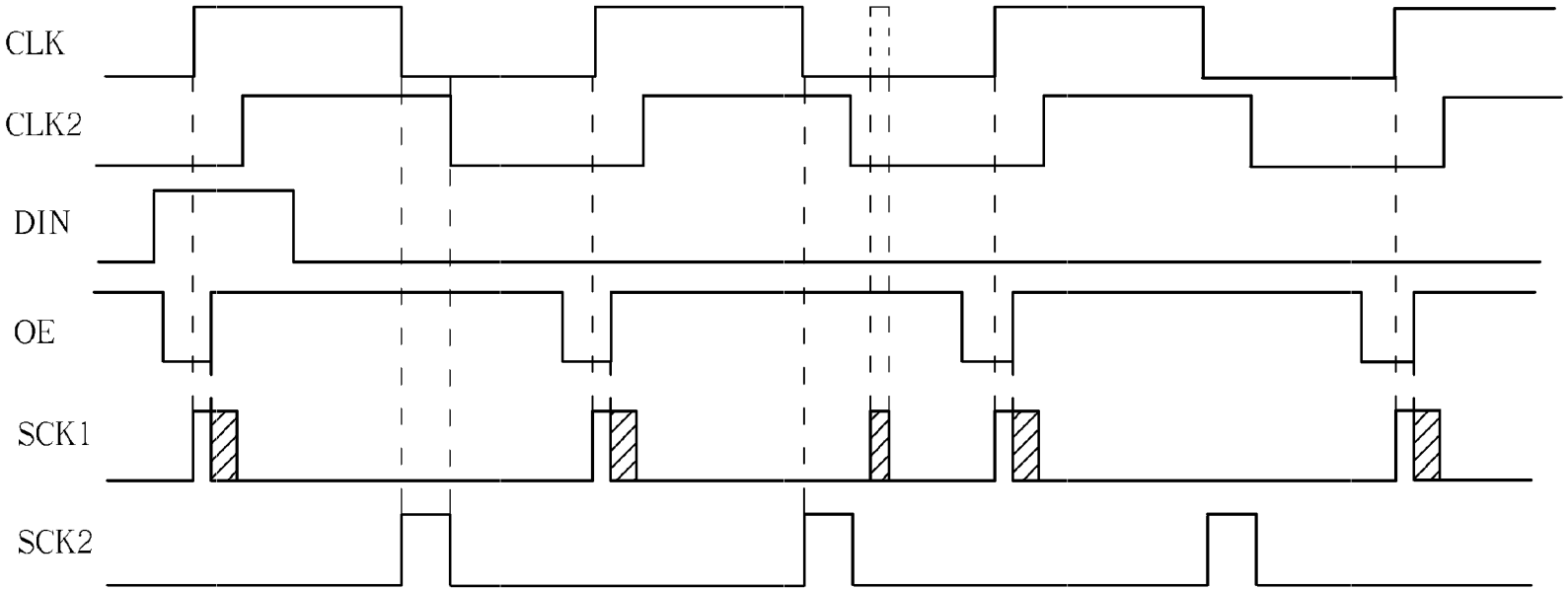
FIG. 16 is a timing sequence diagram of the driving device of FIG. 6 applying an output enable signal to eliminate signal noises.

Please refer to FIG. 16. FIG. 16 is a timing sequence diagram of the driving device 60 of the present invention applying an output enable signal to eliminate signal noises, in which slashed regions represent duration of the control signal SCK1 eliminated by the output enable signal OE. As shown in FIG. 16, when the clock signal CLK exists a noise impulse in duration where both of the clock signals CLK and CLK2 are logic low, the noises that may exist on the control signal SCK1 can then be eliminated by the output enable signal OE. Therefore, no matter where the noise impulses exist on the clock signal, the driving device 60 of the present invention can generate the control signal SCK1 and SCK2 of the shift register correctly, so as to control the shift register to output the pulse signal that is required to drive the LCD in order.

Thus, in addition to utilizing the original clock signal and the noise eliminated clock signal, the driving device 60 of present invention can further utilize the output enable signal to generate the control signals of the shift register, so as to make the shift register correctly generate the pulse signals that are required in driving the LCD without being affected by all kinds of noises of the clock signal.

Besides, the present invention can directly utilize the original clock signal CLK and the output enable signal OE to generate the control signal SCK1 as well. Please refer to FIG. 16 again. Basically, the control signal SCK1 is generated when the clock signal CLK is logic high but the output enable signal OE is logic low, and thus the present invention can merely utilize the original clock signal and the output enable signal OE to generate the control signal SCK1 based on the above-mentioned manner. Such variations also belong to the scope of the present invention.

Figure 17:
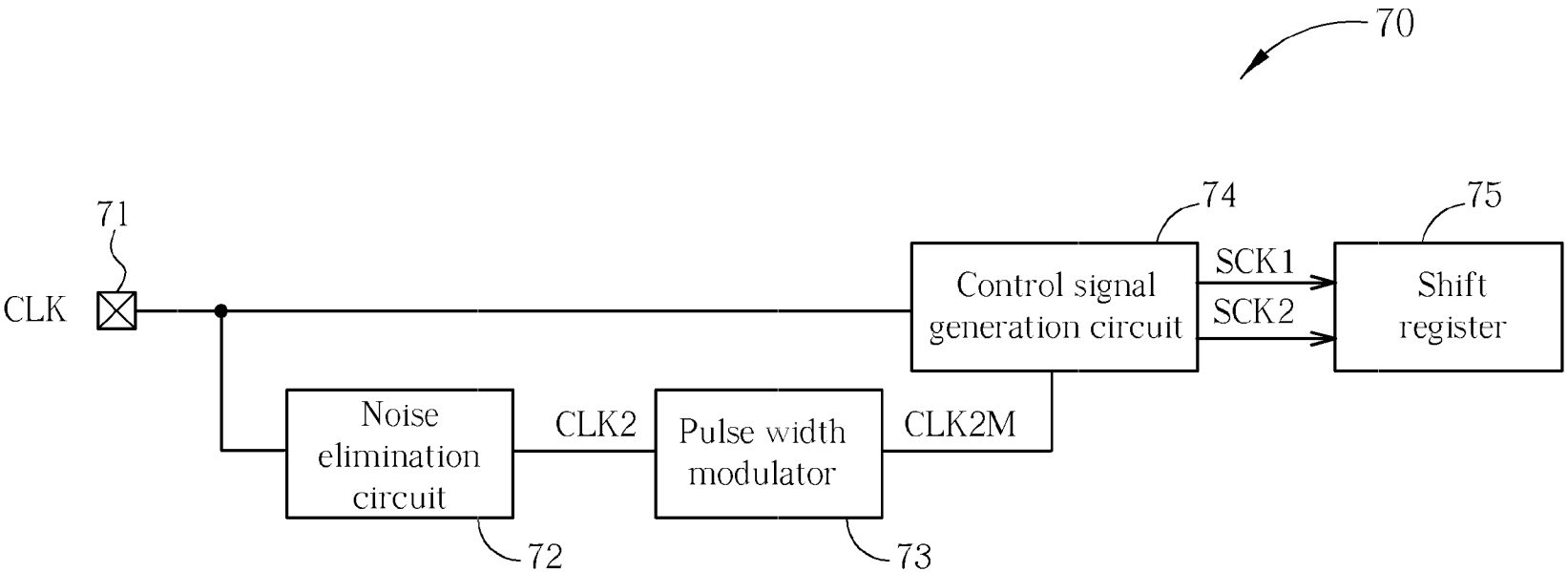
FIG. 17 is a schematic diagram of a driving device for an LCD according to another embodiment of the present invention.

On the other hand, please refer to FIG. 17. FIG. 17 is a schematic diagram of a driving device 70 for an LCD according to another embodiment of the present invention. The driving device 70 includes a reception terminal 71, a noise elimination circuit 72, a pulse width modulator 73, a control signal generation circuit 74 and a shift register 75. The reception terminal 71 is utilized for receiving a clock signal CLK. The noise elimination circuit 72 is coupled to the reception terminal 71, and is utilized for eliminating noises of the clock signal CLK and delaying the clock signal CLK for a preset time to generate a clock signal CLK2. The pulse width modulator 73 is coupled to the noise elimination circuit 72, and is utilized for modulating pulse width of the clock signal CLK2 to generate a clock signal CLK2M. The control signal generation circuit 74 is coupled to the reception terminal 71, the pulse width modulator 73 and the shift register 75, and is utilized for generating control signals SCK1 and SCK2 to control the shift register 75 according to the clock signal CLK1 and CLK2M.

Figure 18:
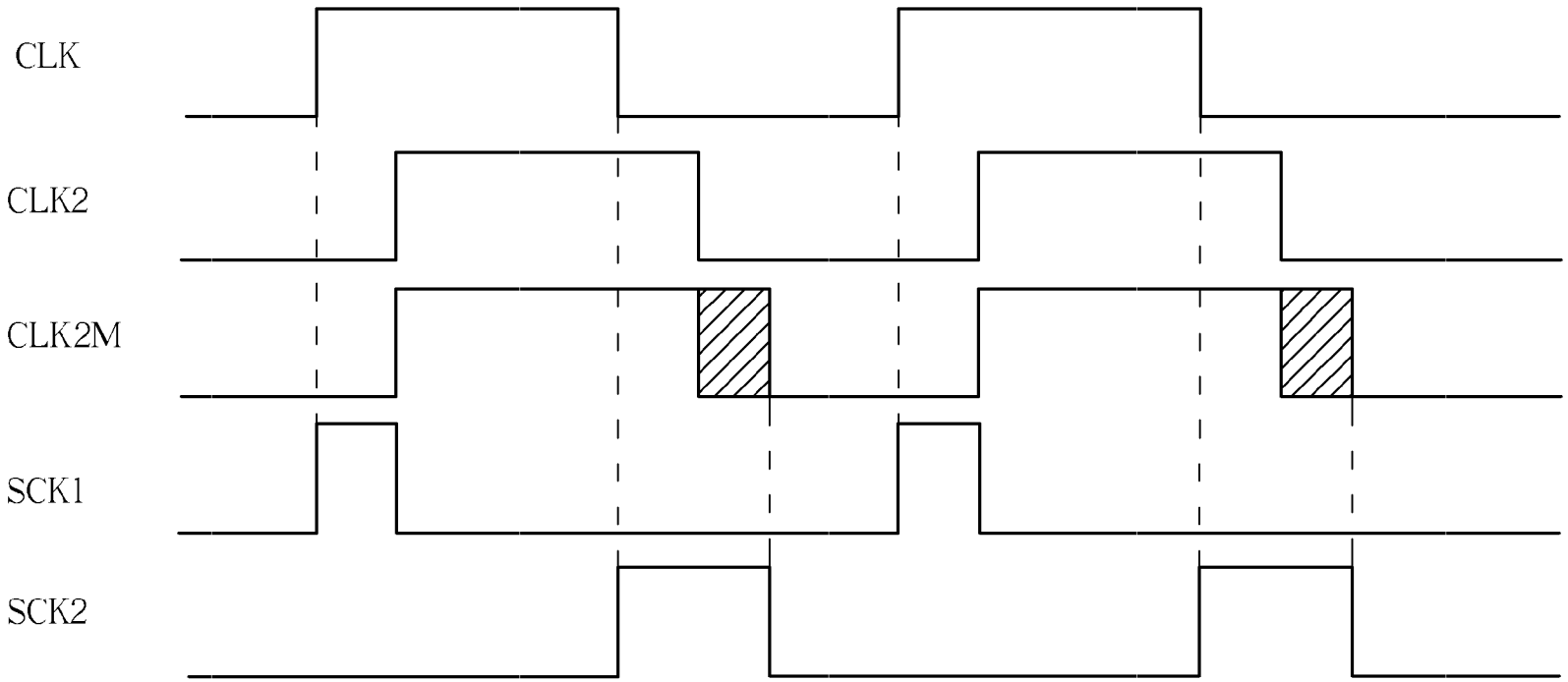
FIG. 18 illustrates related timing sequence of the driving device of FIG. 17.

Thus, compared with the driving device 60, the driving device 70 utilizes the pulse width modulator 73 to extend the pulse width of the clock signal CLK2, so as to increase the range where noises of the clock signal CLK can be eliminated. As for related signal timing sequence of the driving device 70, please refer to FIG. 18, in which slashed region represent extended pulse width of the clock signal CLK.

Figure 19:
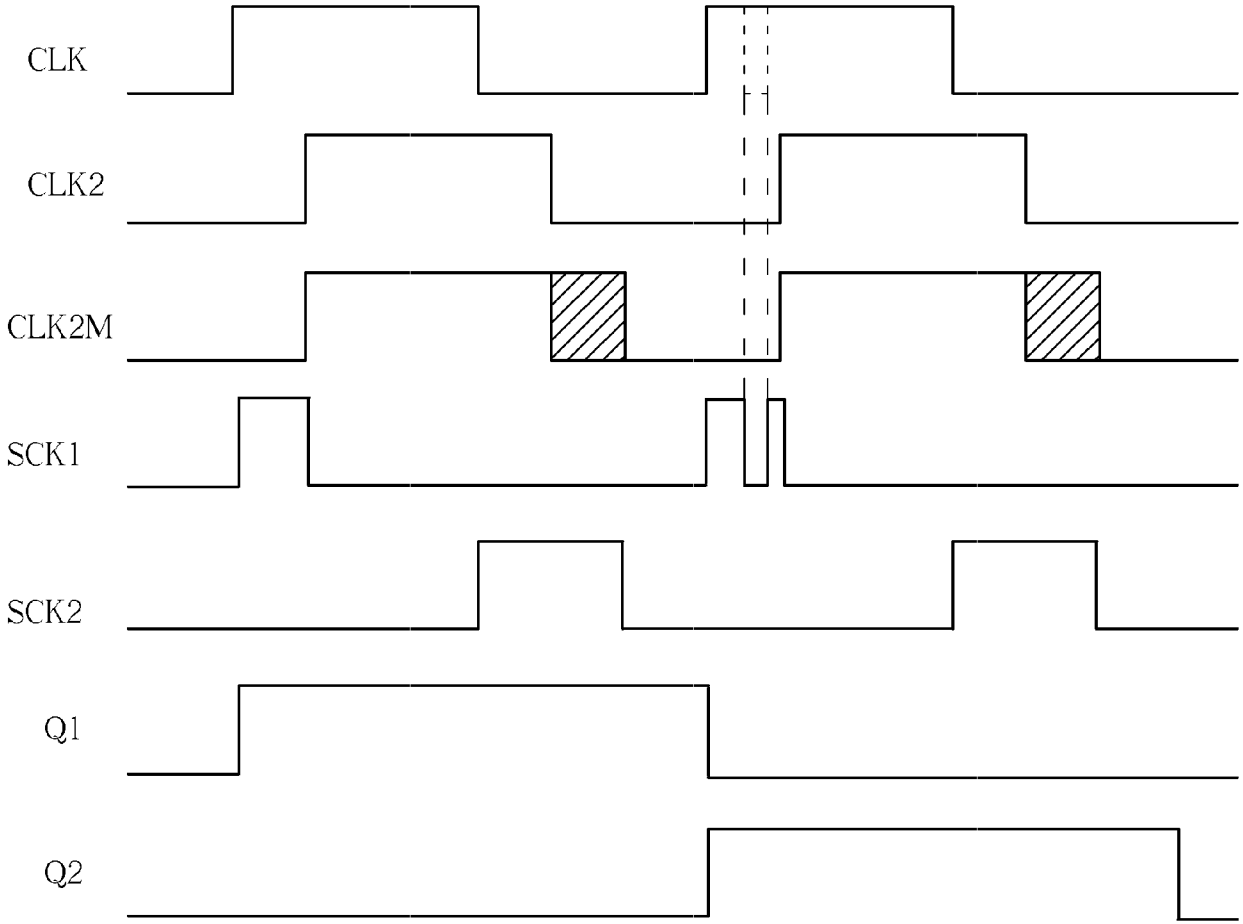
FIG. 19~22 are timing sequence diagrams of the driving device of FIG. 17 operated in different noise situations.
Figure 20:
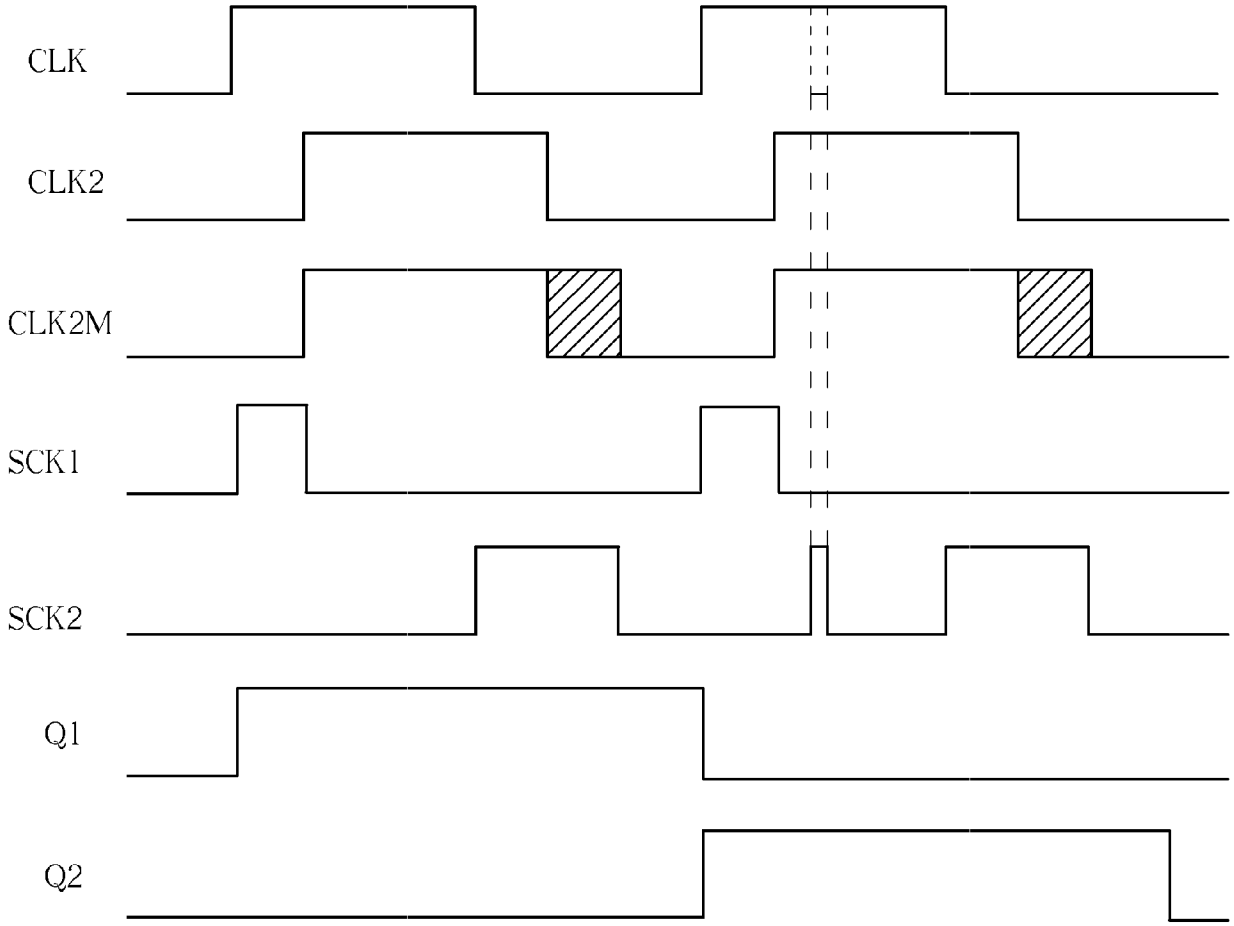
Figure 21:
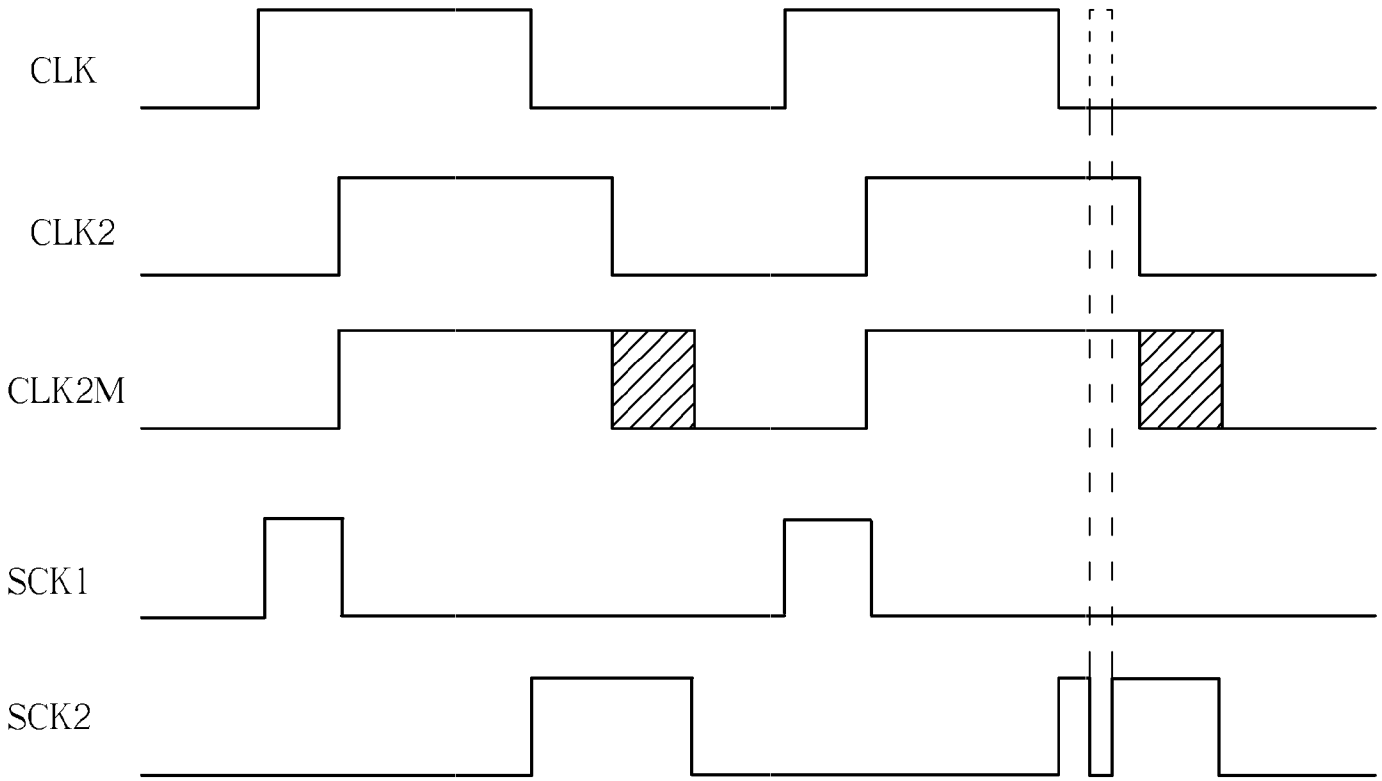
Figure 22:
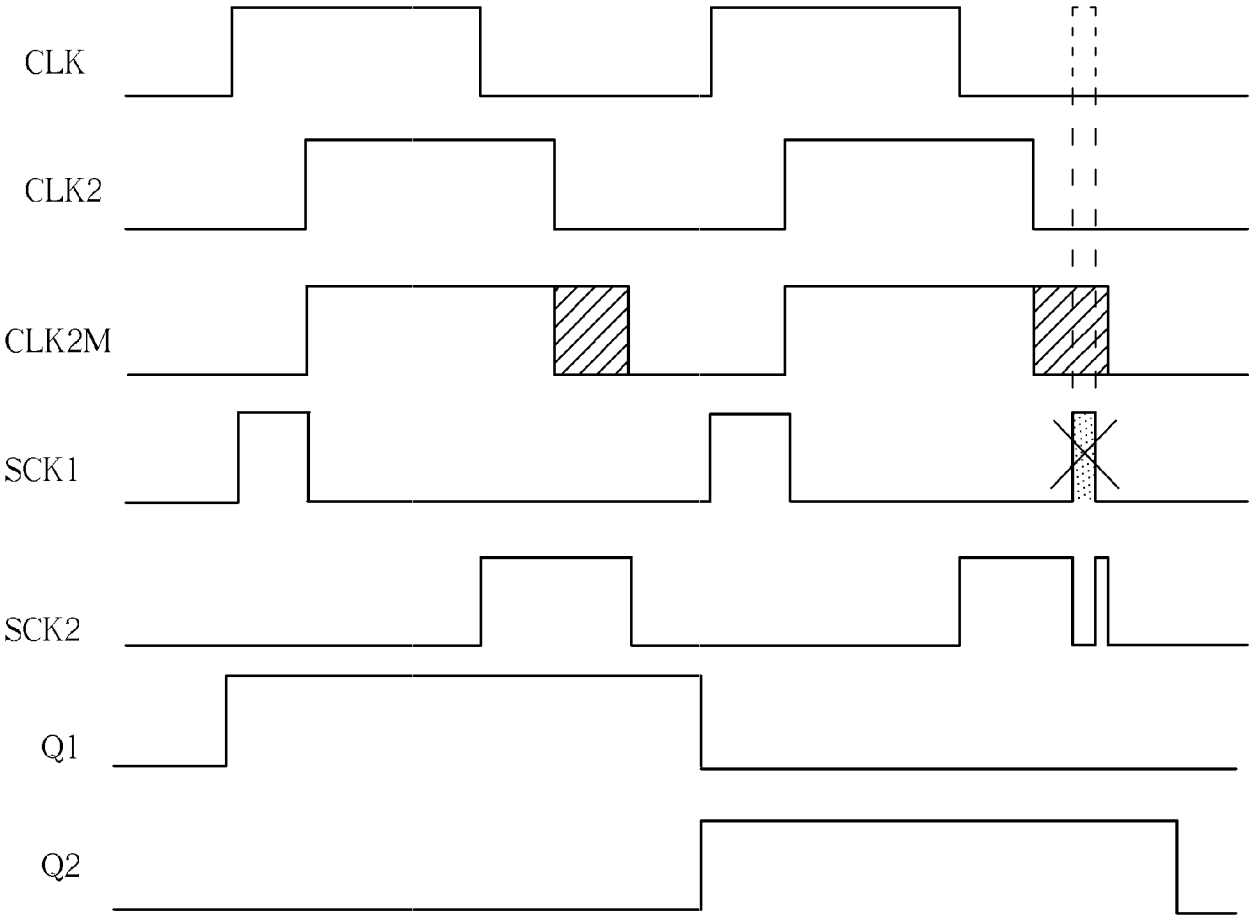

Please refer to FIG. 19~22. FIG. 19~22 are timing sequence diagrams of the driving device 70 operated in different noise situations. In FIG. 19~21, operation of the driving device 70 is similar to that of the driving device 60 in FIG. 12~14, and thus is not narrated again herein. In FIG. 22, if the clock signal CLK has a noise impulse in duration where both of the clock signals CLK and CLK2 are logic low, an additional impulse would be generated on the control signal SCK1, which may advance the output operation of each flip-flop, so as to cause error operation of the shift register. In such a situation, the pulse width modulator 73 is utilized for extending the pulse width of the clock signal CLK2 to illuminate the additional impulse of the control signal SCK1, such that the pulse signals outputted by the shift register would not be affected by the noises of the clock signal.

Therefore, no matter where the noise impulses exist on the clock signal, the control signal SCK1 and SCK2 of the shift register can all be generated correctly by the driving device 70 of the present invention, so as to control the shift register to output the pulse signal that is required to drive the LCD in order.

Please note that the above-mentioned driving device 60 and 70 are merely exemplary illustrations but not limitations of the present invention, and those skilled in the art can certainly make appropriate modifications according to practical demands. For example, in the present invention, the control signal generation circuit can also directly generate the control signal SCK1 according to the clock signal CLK1 and the output enable signal OE, and generate the control signal SCK2 according to the clock signals CLK and CLK2. Such variation also belongs to the scope of the present invention.

In addition, the driving device of the present invention is not restricted to the gate driver, but can also be realized in a source driver to avoid the error operation of the shift register causing the LCD panel abnormally displaying images.

As mentioned above, the present invention utilizes the original clock signal and the noise eliminated clock signal to generate the control signals of the shift register, so as to make the shift register be able to correctly generate the pulse signals that are required in driving the LCD without being affected by all kinds of noises of the clock signal. Therefore, performance of the LCD driving circuit can be effectively improved in the present invention.

Those skilled in the art will readily observe that numerous modifications and alterations of the device and method may be made while retaining the teachings of the invention.

What is claimed is:

1. A driving device for a liquid crystal display, the driving device comprising:

a shift register;

a reception terminal for receiving a first clock signal;

a noise elimination circuit, coupled to the reception terminal, for eliminating noises of the first clock signal and delaying the first clock signal for a preset time to generate a second clock signal, the noise elimination circuit comprising:

an RC (Resistor-Capacitor) filtering circuit, coupled to the reception terminal, for performing a filtering operation on the first clock signal to eliminate the noises of the first clock signal; and a comparator, coupled to the RC filtering circuit, for comparing a filtering result of the first clock signal with a threshold voltage to generate the second clock signal, wherein the second clock signal is logic high when the filtering result of the first clock signal is greater than the threshold voltage, and is logic low when the filtering result of the first clock is smaller than the threshold voltage; and a control signal generation circuit, coupled to the reception terminal, the noise elimination circuit and the shift register, for generating a first control signal and a second control signal according to the first clock signal and the second clock signal to control the shift register.

2. The driving device of claim 1, wherein the control signal generation circuit generates the first control signal when the first clock signal is logic high but the second clock signal is logic low, and generates the second control signal when the first clock signal is logic low but the second clock signal is logic high.

3. The driving device of claim 1, wherein the shift register comprises a plurality of cascaded flip flops, and each of the plurality of flip flops comprises:

a first stage latch for storing an input data according to the second control signal; and a second stage latch for outputting data stored by the first stage latch according to the first control signal.

4. The driving device of claim 1, wherein the preset time is determined by a value of the threshold voltage.

5. The driving device of claim 1, wherein the driving device is a gate driver.

6. The driving device of claim 5, wherein the control signal generation circuit further generates the first control signal for eliminating noises thereon according to an output enable signal, and the output enable signal is utilized for modulating output signals of the gate driver to avoid the adjacent output signals overlapping with each other.

7. The driving device of claim 6, wherein the control signal generation circuit generates the first control signal when the output enable signal is logic low.

8. The driving device of claim 1, wherein the driving device is a source driver.

9. The driving device of claim 1, wherein the driving device is a source driver.

10. A driving device for a liquid crystal display comprising:

a shift register;

a reception terminal for receiving a first clock signal;

a noise elimination circuit, coupled to the reception terminal, for eliminating noises of the first clock signal and delaying the first clock signal for a preset time to generate a second clock signal, the noise elimination circuit comprising:

an RC (Resistor-Capacitor) filtering circuit, coupled to the reception terminal, for performing a filtering operation on the first clock signal to eliminate the noises of the first clock signal; and a comparator, coupled to the RC filtering circuit, for comparing a filtering result of the first clock signal with a threshold voltage to generate the second clock signal, wherein the second clock signal is logic high when the filtering result of the first clock signal is greater than the threshold voltage, and is logic low when the filtering result of the first clock is smaller than the threshold voltage;

a pulse width modulator, coupled to the noise elimination circuit, for modulating pulse width of the second clock signal to generate a third clock signal; and a control signal generation circuit, coupled to the reception terminal, the pulse width modulator and the shift register, for generating a first control signal and a second control signal according to the first clock signal and the third clock signal to control the shift register.

11. The driving device of claim 10, wherein the pulse width modulator extends the pulse width of the second clock signal to generate the third clock signal.

12. The driving device of claim 10, wherein the control signal generation circuit generates the first control signal when the first clock signal is logic high but the third clock signal is logic low, and generates the second control signal when the first clock signal is logic low but the third clock signal is logic high.

13. The driving device of claim 10, wherein the shift register comprises a plurality of cascaded flip flops, and each of the plurality of flip flops comprises:

a first stage latch for storing an input data according to the second control signal; and a second stage latch for outputting data stored by the first stage latch according to the first control signal.

14. The driving device of claim 10, wherein the preset time is determined by a value of the threshold voltage.

15. The driving device of claim 10, wherein the driving device is a gate driver.

16. A driving device for a liquid crystal display comprising:

a shift register;

a reception terminal for receiving a first clock signal;

a noise elimination circuit, coupled to the reception terminal, for eliminating noises of the first clock signal and delaying the first clock signal for a preset time to generate a second clock signal, the noise elimination circuit comprises:

an RC (Resistor-Capacitor) filtering circuit, coupled to the reception terminal, for performing a filtering operation on the first clock signal to eliminate the noises of the first clock signal; and a comparator, coupled to the RC filtering circuit, for comparing a filtering result of the first clock signal with a threshold voltage to generate the second clock signal, wherein the second clock signal is logic high when the filtering result of the first clock signal is greater than the threshold voltage, and is logic low when the filtering result of the first clock is smaller than the threshold voltage; and a control signal generation circuit, coupled to the reception terminal, the noise elimination circuit and the shift register, for generating a first control signal according to the first clock signal and an output enable signal, and generating a second control signal according to the first clock signal and the second clock signal;

wherein the output enable signal is utilized for modulating output signals of the driving device to avoid the adjacent output signals overlapping with each other, and the first control signal and the second control signal are utilized for controlling the shift register.

17. The driving device of claim 16, wherein the control signal generation circuit generates the first control signal when the first clock signal is logic high but the Output Enable signal is logic low, and generates the second control signal when the first clock signal is logic low but the second clock signal is logic high.

18. The driving device of claim 16, wherein the shift register comprises a plurality of cascaded flip flops, and each of the plurality of flip flops comprises:

a first stage latch for storing an input data according to the second control signal; and a second stage latch for outputting data stored by the first stage latch according to the first control signal.

19. The driving device of claim 16, wherein the preset time is determined by a value of the threshold voltage.

20. The driving device of claim 16, wherein the driving device is a gate driver.

* * * * *